US005821446A

United States Patent [19]

Chatley, Jr.

[11] Patent Number: 5,821,446

[45] Date of Patent: Oct. 13, 1998

[54] INFLATOR FOR AN INFLATABLE VEHICLE OCCUPANT PROTECTION DEVICE

[75] Inventor: Glenn R. Chatley, Jr., Mesa, Ariz.

[73] Assignee: TRW Inc., Lyndhurst, Ohio

[21] Appl. No.: 863,460

[22] Filed: May 27, 1997

[51] Int. Cl.[6] ..... F42B 3/12

[52] U.S. Cl. ..... 102/202.7; 102/202.5; 102/202.14; 102/531; 280/741

[58] Field of Search ..... 102/202, 202.1, 102/202.2, 202.5, 202.7, 202.8, 202.9, 202.11, 202.12, 202.13, 202.14, 530, 531; 280/737, 741

[56] References Cited

U.S. PATENT DOCUMENTS

| | | | |
|---|---|---|---|
| 722,913 | 3/1903 | Schmitt et al. | 102/202.11 |
| 1,832,052 | 11/1931 | Schmitt et al. | 102/202.8 |
| 2,159,229 | 3/1939 | Rubenstein et al. | 102/202.11 |
| 2,363,254 | 11/1944 | Lawrence | 102/202.11 |
| 2,821,139 | 1/1958 | Apstein et al. . | |
| 2,920,569 | 1/1960 | Menke et al. | 102/202.9 |
| 2,921,521 | 1/1960 | La Haye et al. | 102/202 |
| 3,213,791 | 10/1965 | Schnettler . | |
| 3,227,083 | 1/1966 | Moses et al. . | |
| 5,140,906 | 8/1992 | Little, II . | |
| 5,348,344 | 9/1994 | Blumenthal et al. . | |
| 5,394,801 | 3/1995 | Faber et al. | 102/202.11 |
| 5,403,036 | 4/1995 | Zakula et al. . | |
| 5,596,163 | 1/1997 | Caflisch et al. | 102/202.9 |

FOREIGN PATENT DOCUMENTS

| | | | |
|---|---|---|---|
| 1030232 | 5/1958 | Germany | 102/202.11 |

*Primary Examiner*—Harold J. Tudor
*Attorney, Agent, or Firm*—Tarolli, Sundheim, Covell, Tummino & Szabo

[57] ABSTRACT

An inflator (14) includes an electrically actuatable igniter (24) which, when actuated, actuates the inflator (14). The igniter (24) includes an ohmic heating element (44), an ignition droplet (46), and structure (40, 50) supporting the ohmic heating element (44) in ignitable heat transferring relationship with the ignition droplet (46). The ignition droplet (46) and the supporting structure (40, 50) have adjoining surfaces with configurations establishing a mechanical interlock between the ignition droplet (46) and the supporting structure (40, 50).

4 Claims, 1 Drawing Sheet

INFLATOR FOR AN INFLATABLE VEHICLE OCCUPANT PROTECTION DEVICE

FIELD OF THE INVENTION

The present invention relates to an inflator, and particularly relates to an inflator for an inflatable vehicle occupant protection device such as an air bag.

BACKGROUND OF THE INVENTION

An inflator for an inflatable vehicle occupant protection device, such as an air bag, may contain inflation fluid under pressure. Such an inflator is disclosed in U.S. Pat. No. 5,348,344. In the inflator disclosed in the '344 patent, the inflation fluid is an ingredient in a mixture of gases. The mixture of gases further includes a fuel gas which, when ignited, heats the inflation fluid.

The inflator has an igniter containing a small charge of pyrotechnic material. The igniter further contains a bridgewire which is supported in an ignitable heat transferring relationship with the pyrotechnic material. When the air bag is to be inflated, an actuating level of electric current is directed through the bridgewire in the igniter. This causes the bridgewire to become resistively heated sufficiently to ignite the pyrotechnic material. The pyrotechnic material then produces combustion products which, in turn, ignite the fuel gas in the inflator.

The fluid pressure inside the inflator is increased by the heat generated upon combustion of the fuel gas. The inflation fluid then flows outward from the inflator and into the air bag to inflate the air bag more quickly than if the inflation fluid had not been heated and further pressurized.

SUMMARY OF THE INVENTION

In accordance with the present invention, an apparatus comprises an inflator including an electrically actuatable igniter which, when actuated, actuates the inflator.

The igniter includes an ohmic heating element, an ignition droplet, and structure supporting the ohmic heating element in ignitable heat transferring relationship with the ignition droplet. The ignition droplet and the supporting structure have adjoining surfaces with configurations establishing a mechanical interlock between the ignition droplet and the supporting structure.

BRIEF DESCRIPTION OF THE DRAWINGS

Further features of the present invention will become apparent to those skilled in the art to which the present invention relates from reading the following description with reference to the accompanying drawings, in which.

DESCRIPTION OF PREFERRED EMBODIMENTS

Figure 1:
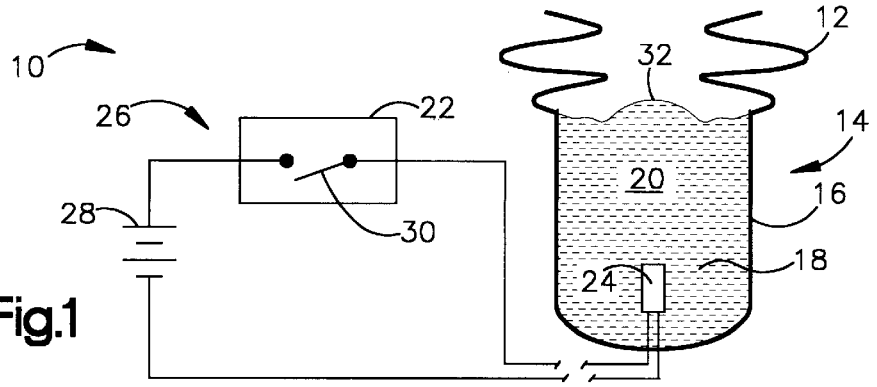
FIG. 1 is a schematic view of a vehicle occupant protection apparatus comprising a first embodiment of the present invention.

A vehicle occupant protection apparatus 10 comprising a first embodiment of the present invention is shown schematically in FIG. 1. The apparatus 10 includes a particular type of inflatable vehicle occupant protection device 12 which is commonly referred to as an air bag. Other inflatable vehicle occupant protection devices that can be used in accordance with the invention include, for example, inflatable seat belts, inflatable knee bolsters, inflatable head liners or side curtains, and knee bolsters operated by inflatable air bags. The apparatus 10 further includes an inflator 14 which comprises a source of inflation fluid for inflating the air bag 12. When the air bag 12 is inflated, it extends into a vehicle occupant compartment (not shown) to help protect a vehicle occupant from a forceful impact with parts of the vehicle as a result of a crash.

The inflator 14 comprises a container 16 which stores pressurized inflation fluid for inflating the air bag 12. The container 16 also stores ignitable material for heating the inflation fluid. Specifically, the container 16 in the preferred embodiment of the present invention stores a pressurized, combustible mixture of gases 18 in a storage chamber 20. The combustible mixture of gases 18 includes a primary gas and a fuel gas. The primary gas comprises the majority of the inflation fluid that inflates the air bag 12. The fuel gas, when ignited, heats the primary gas.

The combustible mixture of gases 18 may have any suitable composition known in the art, but preferably has a composition in accordance with the invention set forth in U.S. Pat. No. 5,348,344, to Blumenthal et al., entitled APPARATUS FOR INFLATING A VEHICLE OCCUPANT RESTRAINT USING A MIXTURE OF GASES, and assigned to TRW Vehicle Safety Systems Inc. Accordingly, the primary gas preferably includes an inert gas for inflating the air bag and an oxidizer gas for supporting combustion of the fuel gas. The primary gas may include air, an inert gas, or a mixture of air and an inert gas. The inert gas may be nitrogen, argon or a mixture of nitrogen and argon. For example, the primary gas may be air, with the oxidizer gas being the oxygen in the air. The fuel gas may be hydrogen, methane, or a mixture of hydrogen and methane. Preferably, the fuel gas is hydrogen. A preferred composition of the mixture of gases is about 12% by volume hydrogen and about 88% by volume air. The storage pressure in the chamber 20 may vary, but is preferably within the range of approximately 1,500 psi to approximately 5,000 psig., and is most preferably approximately 2,500 psig.

Although the structure of the inflator 14 in the preferred embodiment of the present invention includes a single container 16 storing the combustible mixture of gases 18 as a whole in a single storage chamber 20, ingredients of the mixture could alternatively be stored separately, with the mixture being created by mixing the ingredients when the inflator 14 is actuated. For example, as disclosed in U.S. Pat. No. 5,348,344, an inflator structure can contain a fuel gas and an oxidizer gas which are stored separately from an inert gas, and which are mixed with the inert gas upon actuation of the inflator.

The apparatus 10 further includes a crash sensor 22 and an electrically actuatable igniter 24. As shown schematically in FIG. 1, the crash sensor 22 and the igniter 24 are included in an electrical circuit 26 with a power source 28. The power source 28 is preferably the vehicle battery and/or a capacitor. The crash sensor 22 includes a normally open switch 30. As known in the art, the crash sensor 22 monitors vehicle conditions to sense a vehicle condition indicating the occurrence of a crash. The crash-indicating condition may comprise, for example, sudden vehicle deceleration that is caused by a crash. If the crash-indicating condition is at or above a predetermined threshold level, it indicates the occurrence of a crash having at least a predetermined threshold level of severity. The threshold level of crash severity is a level at which inflation of the air bag 12 is desired to help protect an occupant of the vehicle. The switch 30 then closes and an actuating level of electric current is directed to flow through the igniter 24 to actuate the igniter 24.

When the igniter 24 is actuated, it ignites the fuel gas in the mixture of gases 18. The resulting combustion of the fuel gas is supported by the oxidizer gas. As the fuel gas burns, the pressure in the storage chamber 20 rises due to warming of the gases by the heat of combustion created by burning of the fuel gas. A rupturable closure wall 32 bursts open when the increasing pressure in the storage chamber 20 reaches a predetermined elevated level. The warm inflation gas then flows outward from the storage chamber 20 and into the air bag 12 to inflate the air bag 12.

The fuel gas is preferably included in the mixture of gases 18 in an amount so that it is substantially consumed by combustion in the storage chamber 20. The air bag 12 is thus inflated almost exclusively, in the case where inert gas is used, by inert gas, combustion products created by burning of the fuel gas, and any remaining oxidizer gas. In the case where inert gas is not used, the air bag 12 is inflated almost exclusively by combustion products and the remaining oxidizer gas.

Figure 2:
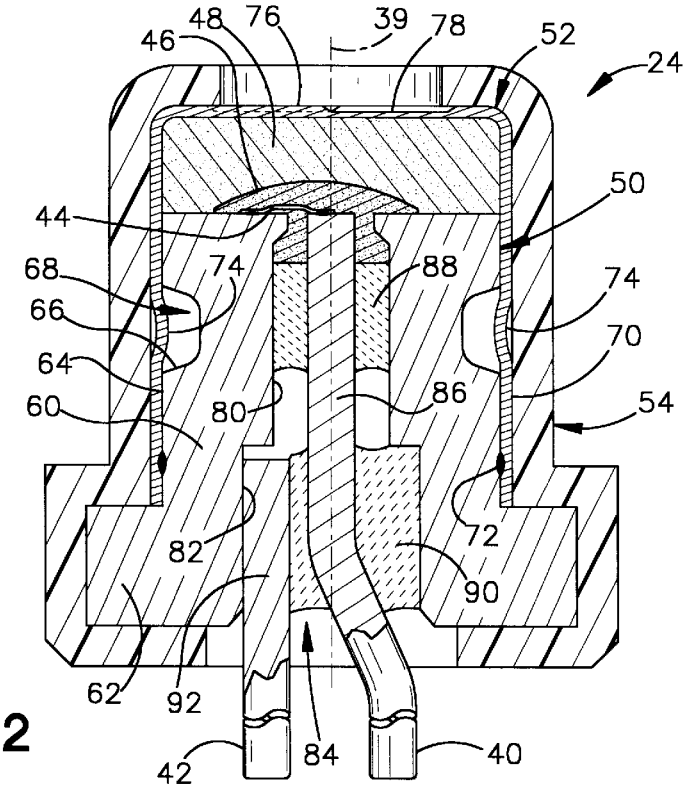
FIG. 2 is an enlarged sectional view of a part of the apparatus of in FIG. 1.

As shown in detail in FIG. 2, the igniter 24 is a generally cylindrical part with a central axis 39 and a pair of axially projecting electrodes 40 and 42. An ohmic (resistive) heating element in the form of a bridgewire 44 is connected between the electrodes 40 and 42 within the igniter 24. An ignition droplet 46 and a main pyrotechnic charge 48 are contained within the igniter 24. The ignition droplet 46 and the main pyrotechnic charge 48 may be formed of any suitable pyrotechnic materials known in the art.

When the igniter 24 is actuated, as described above with reference to FIG. 1, the actuating level of electric current is directed through the igniter 24 between the electrodes 40 and 42. As the actuating level of electric current is conducted through the bridgewire 44, the bridgewire 44 resistively generates heat which is transferred directly to the ignition droplet 46. The ignition droplet 46 is then ignited and produces combustion products including heat, hot gases and hot particles which ignite the main pyrotechnic charge 48. The main pyrotechnic charge 48 then produces additional combustion products which are spewed outward from the igniter 24 and into the combustible mixture of gases 18 (FIG. 1) to ignite the fuel gas.

The parts of the igniter 24 shown in FIG. 2 further include a plug 50, a charge cup 52 and a casing 54. The plug 50 is a metal part with a generally cylindrical body 60 and a circular flange 62 projecting radially outward from one end of the body 60. A cylindrical outer surface 64 of the body 60 has a recessed portion 66 defining a circumferentially extending groove 68.

The charge cup 52 also is a metal part, and has a cylindrical side wall 70 received closely over the body 60 of the plug 50. The side wall 70 of the charge cup 52 is fixed and sealed to the body 60 of the plug 50 by a circumferentially extending weld 72. The charge cup 52 is further secured to the plug 50 by a plurality of circumferentially spaced portions 74 of the side wall 70 which are crimped radially inward into the groove 68. In this arrangement, the side wall 70 and a circular end wall 76 of the charge cup 52 together contain and hold the main pyrotechnic charge 48 against the end of the plug 50 opposite the flange 62. A plurality of thinned portions 78 of the end wall 76, one of which is shown in FIG. 2, extend radially outward from the central axis 39. The thinned portions 78 of the end wall 76 function as stress risers which rupture under the influence of the combustion products generated by the main pyrotechnic charge 48 when the igniter 24 is actuated. The casing 54 is a sleeve-shaped plastic part which is shrink fitted onto the plug 50 and the ignition cup 52 so as to insulate and partially encapsulate those parts.

As further shown in FIG. 2, the plug 50 has a pair of cylindrical inner surfaces 80 and 82 which together define a central passage 84 extending through the plug 50. The first electrode 40 has an inner end portion 86 extending along the entire length of the central passage 84. A pair of axially spaced apart glass seals 88 and 90 support the first electrode 40 in the central passage 84, and electrically insulate the first electrode 40 from the plug 50. The second electrode 42 has an inner end portion 92 extending partly into the central passage 84 in contact with the second cylindrical inner surface 82 of the plug 50. The second glass seal 90 insulates the electrodes 42 and 40 from one another.

Figure 3:
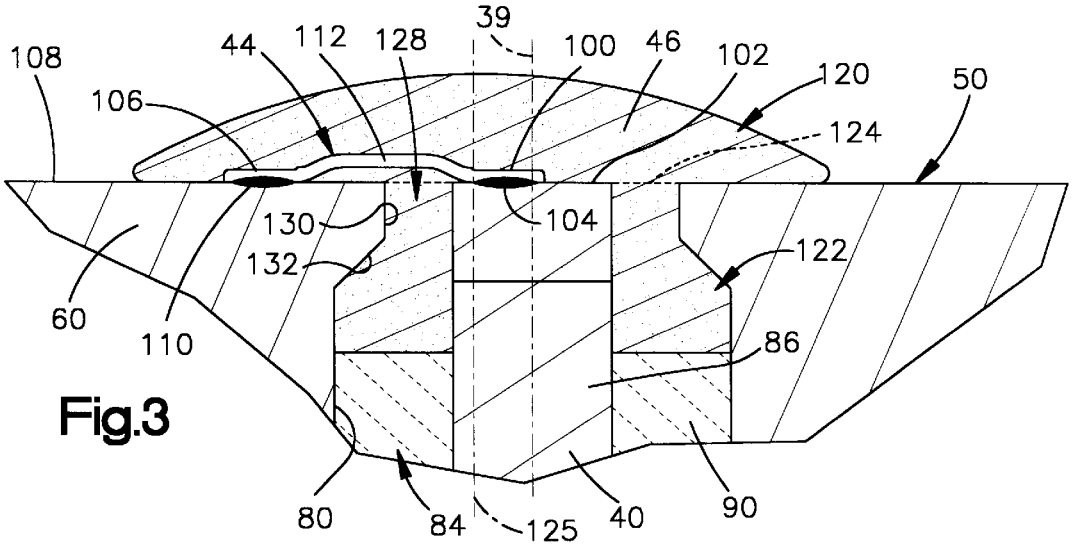
FIG. 3 is an enlarged partial view of the part shown in FIG. 2.

The bridgewire 44 and the ignition droplet 46 are shown in greater detail in FIG. 3. Specifically, FIG. 3 is an enlarged, partial view of the igniter 24 in a partially assembled condition in which the ignition droplet 46 has been installed over the bridgewire 44 before the charge cup 52 (which contains the main pyrotechnic charge 48) is installed over the plug 50.

The bridgewire 44 extends from the first electrode 40 to the plug 50. A first end portion 100 of the bridgewire 44 is fixed to a planar, circular end surface 102 of the electrode 40 by an electrical resistance weld 104. A second end portion 106 of the bridgewire 44 is fixed to a coplanar, annular end surface 108 of the plug 50 by another electrical resistance weld 110. The opposite end portions 100 and 106 of the bridgewire 44 become flattened under the pressure applied by welding electrodes (not shown) that are used to form the resistance welds 104 and 110. The bridgewire 44 thus has an unflattened major portion 112 extending longitudinally between the opposite end portions 100 and 106. The major portion 112 of the bridgewire 44 extends away from the opposite end portions 100 and 106 so as to be spaced from the electrode 40 and the plug 50 fully along its length between the opposite end portions 100 and 106.

The ignition droplet 46 is a solid cohesive body of pyrotechnic material. As shown in FIG. 3, the ignition droplet 46 has two generally distinct portions 120 and 122. The two portions 120 and 122 of the ignition droplet 46 are located on opposite sides of a plane 124 common to the planar end surfaces 102 and 108 of the electrode 40 and the plug 50. Accordingly, the first portion 120 of the ignition droplet 46 is located outside the central passage 84 in the plug 50, with the second portion 122 being located inside the central passage 84.

The first portion 120 of the ignition droplet 46 has the shape of a somewhat spherical segment with a generally circular periphery centered on an axis 125, and with an arcuate radial profile generally symmetrical about the axis 125. The first portion 120 is preferably large enough to cover the entire bridgewire 44, and most preferably extends fully around the major portion 112 of the bridgewire 44 along its entire length. This maximizes the surface area of the bridgewire 44 in ignitable heat transferring relationship with the ignition droplet 46.

The second portion 122 of the ignition droplet 46 fills a cavity 128 in the plug 50. The cavity 128 comprises an end portion of the central passage 84 in the plug 50. More specifically, an annular inner surface 130 of the plug 50 extends axially inward from the planar end surface 108. A frustoconical inner surface 132 of the plug 50 extends axially inward, and radially outward, from the annular inner surface 130 to the cylindrical inner surface 80. The volume of the cavity 128 is defined axially between the plane 124 and the glass seal 88, and radially between the electrode 40 and the surrounding surfaces 130, 132 and 80 of the plug 50. Since the closed inner end of the cavity 128 at the glass seal 88 is wider, i.e., has a greater diameter, than the open outer end of the cavity 128 at the plane 124, the adjoining surfaces of the plug 50 and the second portion 122 of the ignition droplet 46 establish a mechanical interlock which blocks movement of the second portion 122 outward of the cavity 128. The mechanical interlock thus retains the ignition droplet 46 securely in its installed position on the plug 50.

The ignition droplet 46 is installed by depositing it in the position of FIG. 3 in a fluid condition. Although the fluid material of which the ignition droplet 46 is formed may have any suitable composition known in the art, it most preferably has a viscosity that enables it to flow fully around the bridgewire 44 and throughout the cavity 128 so as to attain the configuration of FIG. 3 without voids. The fluid material then cures to a cohesive solid state. It may be desirable to form the ignition droplet 46 of a mixture of a solid pyrotechnic material and a liquid resin binder which is curable under the influence of ultraviolet radiation, as set forth in co-pending U.S. patent application Ser. No. 08/815,251, filed Mar. 12, 1997, entitled "Inflator for an Inflatable Vehicle Occupant Protection Device."

The ignition droplet 46 may become deflected slightly from the configuration of FIG. 3 when the main pyrotechnic charge 48 is subsequently moved to the position of FIG. 2 upon installation of the charge cup 52 over the plug 50. However, since the ignition droplet 46 is mechanically interlocked with the plug 50 in accordance with the present invention, it is not necessary for the main pyrotechnic charge 48 to help hold the ignition droplet 46 in place on the plug 50. Therefore, the main pyrotechnic charge 48 can be packed somewhat loosely into the charge cup 52 without a significant amount of compression that might otherwise be needed to engage the ignition droplet 46 firmly enough to help hold it in place.

From the above description of the invention, those skilled in the art will perceive improvements, changes and modifications. Such improvements, changes and modifications within the skill of the art are intended to be covered by the appended claims.

Having described the invention, the following is claimed:

1. Apparatus comprising:

an electrically conductive igniter body having inner surfaces defining a passage, said passage having an open end and an inner portion wider than said open end, said igniter body further having an outer end surface surrounding said open end of said passage;

an electrode in said passage in said igniter body;

an ohmic heating element being outside said passage and bridging said electrode and said outer end surface of said igniter body; and an ignition droplet comprising a cohesive solid body of pyrotechnic material with an inner portion inside said passage and an outer portion outside said passage, said outer portion of said body of pyrotechnic material adjoining said ohmic heating element in ignitable heat transferring relationship with said ohmic heating element and said outer portion of said body of pyrotechnic material partially overlies said outer end surface of said igniter body around said open end of said passage, said inner portion of said body of pyrotechnic material extending from said open end of said passage into said wider inner portion of said passage in a mechanical interlock with said igniter body.

2. Apparatus as defined in claim 1 wherein said outer portion of said body of pyrotechnic material has the shape of a spherical segment with a circular periphery centered on an axis and an arcuate radial profile symmetrical about said axis.

3. Apparatus as defined in claim 1 wherein said ohmic heating element extends from a terminal end surface of said electrode to said outer end surface of said igniter body and is located entirely outside said passage.

4. Apparatus as defined in claim 3 wherein said terminal end surface of said electrode and said outer end surface of said igniter body comprise planar surfaces, said inner and outer portions of said body of pyrotechnic material being located on opposite sides of a plane common to said planar surfaces.

* * * * *